United States Patent [19]

Warner

[11] Patent Number: 4,918,912

[45] Date of Patent: Apr. 24, 1990

[54] CUT AND ABRASION RESISTANT SPUN YARNS AND FABRICS

[75] Inventor: Grant H. Warner, Hockessin, Del.

[73] Assignee: E. I. du Pont de Nemours and Company, Wilmington, Del.

[21] Appl. No.: 354,196

[22] Filed: May 19, 1989

[51] Int. Cl.[5] ..... D02G.3/04; D02G 3/44; A43B 17/00; A41B 11/02

[52] U.S. Cl. ..... 57/255; 2/241; 19/145.5; 57/252; 57/254; 428/225; 428/357; 428/359; 428/401

[58] Field of Search ..... 57/315, 200, 206–208, 57/328, 252–257, 243–245, 238, 239; 19/0.3–0.64, 145.5, 145.7, 150; 428/224, 225, 357, 359, 362, 364, 365, 369, 397–401; 2/239–242

[56] References Cited

U.S. PATENT DOCUMENTS

| | | | |
|---|---|---|---|
| 4,466,237 | 8/1984 | Sawyer | 57/254 |
| 4,686,710 | 8/1989 | Marston et al. | 2/2 |
| 4,698,956 | 10/1987 | Clarke et al. | 57/255 X |

FOREIGN PATENT DOCUMENTS 1591967 7/1981 United Kingdom .

*Primary Examiner*—John Petrakes

[57] ABSTRACT

Spun yarns and fabrics having a high level of both abrasion and cut-resistance are disclosed. Such yarns are made from a blend of about 40–60 percent para-aramid fiber, about 20–40 percent nylon fiber, and about 10–30 percent acrylic fiber. The yarns and fabrics are particularly useful in making articles of clothing such as socks.

8 Claims, No Drawings

CUT AND ABRASION RESISTANT SPUN YARNS AND FABRICS

TECHNICAL FIELD

This invention relates to spun yarns made from a blend of para-aramid, nylon, and acrylic fibers as well as to fabrics and articles of clothing made therefrom. Such yarns and fabrics exhibit both good cut and abrasion resistance and are particularly useful in articles of clothing such as socks.

BACKGROUND OF THE INVENTION

A major problem with socks is wear in the heel and toe. Socks made solely of cotton or wool, or of blends of cotton and/or wool with synthetic fibers such as acrylic or polyester rapidly develop holes in the heel and toe. A great advance in durability was made by incorporating nylon in the heel and toe of socks. Although holes in the heel are not now as prevalent, holes in the toe still tend to appear before socks have otherwise outworn their usefulness. This wear may occur as a result of the cutting action, as well as the abrasive action, of the toenails (particularly that of the large toe) pressing the sock against the inside of the shoe.

The more active lifestyle of recent times has increased the demand for improved wear performance in socks. Since no commercially available fiber having an abrasion resistance superior to nylon 6,6 is known, attention was turned to improving cut-resistance.

SUMMARY OF THE INVENTION

It has now been found that spun yarns comprised of about 40–60 percent para-aramid fiber, about 20–40 percent nylon fiber, and about 10–30 percent acrylic fiber exhibit a surprising combination of abrasion and cut resistance. The preferred blend of about 50 percent para-aramid fiber, about 30 percent nylon—preferably nylon 6,6—fiber, and about 20 percent acrylic fiber can be knit or woven into fabrics and used to make articles of clothing such as socks which have the desired high level of cut and abrasion resistance. The yarns and fabrics of the invention also have an acceptable "hand" or feel, making them particularly useful in articles of clothing.

DETAILED DESCRIPTION OF THE INVENTION

Socks were prepared from yarns spun from four different blend combinations of staple fibers and then tested for resistance to both abrasion and cutting. Socks made from Blend #1 represent the base performance against which the other socks are compared. As shown in Table 1, Blend #1 is comprised of 55% acrylic staple fibers, 20% polyester staple fibers, and 25% wool fibers. In this particular blend, the acrylic fibers are 4½–6 inches in length, 6 denier per filament and the polyester fibers are 4½ inches in length, 5.5 denier per filament.

As can be seen by referring to Tables 1–3, yarns made by blending 70% Blend #1 with 30% of 4½ inch, 6 denier per filament, nylon 6,6 staple, when knit into socks using conventional techniques, show the expected improvement in abrasion resistance, but essentially no improvement in resistance to cutting.

Para-aramid fiber is known for its resistance to cutting, but it has relatively poor resistance to abrasion. It was therefore expected that addition of para-aramid fiber would actually decrease the abrasion resistance of yarns containing blends of other fibers. Surprisingly, it is found that socks knitted from yarns containing blends of 70% Blend #1 and 30% 3–5 inch, 2.25 denier per filament para-aramid fiber have abrasion resistance at least equal to the abrasion resistance of socks made entirely from Blend #1 while also having the expected improved resistance to cutting.

From the above results, it would appear that socks with the ultimate resistance to abrasion and cutting could be knit from yarns containing a 50/50 blend of para-aramid and nylon 6,6 staples. However, it is very difficult to spin such yarns, and fabrics made from them, because of the stiffness of the para-aramid, tend to be boardy and unsuitable for use in articles of clothing such as socks.

This problem is resolved by blending acrylic staple with the mixture of para-aramid and nylon 6,6 staples. The addition of the acrylic component allows the blend to be spun without undue difficulty using conventional yarn spinning methods. Socks knit from yarns made from a blend of 50% para-aramid, 30% nylon 6,6 and 20% acrylic staple fibers have abrasion resistance at least equal to socks knit from yarns containing a blend of 70% Blend #1 and 30% nylon 6,6 staple fibers. In addition, the socks are definitely superior in abrasion performance compared to the socks knit from yarns containing 70% Blend #1 and 30% para-aramid staple fibers. This is surprising in view of the substantially higher percentage of para-aramid staple. The cutting resistance is the best of any of the socks tested, and there is a surprising increase in the comfort of the socks, considering the relatively small percentage of acrylic present.

In the Tables, the comparison is made based on socks knit from yarns containing 50% para-aramid fiber, 30% nylon 6,6, and 20% acrylic staple fibers, but other combinations will perform satisfactorily. Each individual component can be varied as much as about ±10% in absolute terms, with appropriate changes in the other two components. Also, filament deniers and staple lengths other than those specified can be used. With respect to the nylon component, nylon 6,6 is preferred due to its superior abrasion resistance, but other nylons, such as nylon 6, can also be used.

The fabrics of the invention can be made in either woven or knitted form using well known methods. From such fabrics articles of clothing can be made in a conventional manner with no particular difficulty. While socks are a preferred article of clothing of the invention, other articles of clothing such as gloves exhibit the same desirable combination of properties.

Minor amounts of other fibers may also be blended in with the component fibers of the invention prior to spinning. In applications where feel is not critical to the finished product, the acrylic component may be reduced or eliminated entirely without sacrificing the desired level of cut and abrasion resistance.

Test Methods

The abrasion resistance reported in Table 2 is measured with the aid of a Taber/CSI-A Abrader. A sample of fabric is placed on the base of the abrader. The flat surface of a Calibraise Wheel H-18 is placed on the fabric under a tension of 1000 g. The wheel travels over the fabric in a circular path. The number of revolutions of the wheel, referred to hereinafter as cycles, required to wear through the fabric is then recorded.

The cutting resistance is measured with the aid of an "Instron" Tensile Tester. A sample of fabric is placed between clamps and held taut in a plane parallel to the base of the tester. A knife with a sharp cutting edge is struck down against the fabric in a plane perpendicular to the plane of the fabric. The tester measures the force in pounds required to cut through the fabrics. Since the surface of knitted socks differs from outside to inside, separate tests are run with the inside (Terry side) and the smooth outside (Jersey side) facing the knife.

Abrasion resistance data are presented in Table 2 and cutting resistance data in Table 3. The test item blends are identified in Table 1. Percentages set forth herein are by weight unless otherwise indicated.

TABLE 1

| Blend No. | Yarn Composition |
|---|---|
| 1 | 55% acrylic/20% polyester/ 25% wool |
| 2 | 70% Blend #1/30% nylon 6,6 |
| 3 | 70% Blend #1/30% para-aramid |
| 4 | 50% para-aramid/30% nylon 6,6/20% acrylic |

TABLE 2

| | ABRASION TEST | |
|---|---|---|
| Blend No. | Inside Sock - Terry Side (Cycles) | Outside Sock - Jersey Side (Cycles) |
| 1 | 568 | 341 |

TABLE 2-continued

| | ABRASION TEST | |
|---|---|---|
| Blend No. | Inside Sock - Terry Side (Cycles) | Outside Sock - Jersey Side (Cycles) |
| 2 | 762 | 373 |
| 3 | 569 | 348 |
| 4 | 699 | 538 |

TABLE 3

| | CUT TEST RESULTS | |
|---|---|---|
| Blend No. | Inside Sock - Terry Side (lbs.) | Outside Sock - Jersey Side (lbs.) |
| 1 | 7.4 | 7.4 |
| 2 | 8.0 | 6.6 |
| 3 | 11.1 | 9.5 |
| 4 | 14.0 | 10.6 |

I claim:

1. A spun yarn comprised of about 40–60 percent para-aramid fiber, about 20–40 percent nylon fiber, and about 10–30 percent acrylic fiber.

2. A spun yarn of claim 1 wherein the percentage of para-aramid fiber is about 50 percent, the percentage of nylon fiber is about 30 percent, and the percentage of acrylic fiber is about 20 percent.

3. A fabric made using a spun yarn of claim 2.

4. An article of clothing made using a fabric of claim 3.

5. A sock made using a fabric of claim 3.

6. A fabric made using a spun yarn of claim 1.

7. An article of clothing made using a fabric of claim 6.

8. A sock made using a fabric of claim 6.

* * * * *